United States Patent [19]

Louis

[11] 4,173,721

[45] Nov. 6, 1979

[54] WINDOW SHADE CONTROLS AND METHOD ASSOCIATED THEREWITH

[76] Inventor: Emma D. Louis, 157-11 N. Conduit Ave., Jamaica, N.Y. 11434

[21] Appl. No.: 887,639

[22] Filed: Mar. 17, 1978

[51] Int. Cl.[2] ..... H01H 3/06; H01H 5/06

[52] U.S. Cl. ..... 307/115; 307/132 R; 160/2; 160/176 R

[58] Field of Search ..... 307/141, 141.4; 200/61.84, DIG. 12; 49/29, 30, 74; 160/1, 2, 7, 176

[56] References Cited

U.S. PATENT DOCUMENTS

| | | | |
|---|---|---|---|
| 2,761,930 | 9/1956 | Smith | 307/141.4 |
| 2,907,901 | 10/1959 | Parker | 307/141 |
| 2,980,970 | 4/1961 | Dickenson | 49/29 |

FOREIGN PATENT DOCUMENTS

| | | | |
|---|---|---|---|
| 1288072 | 9/1972 | United Kingdom | 160/1 R |

*Primary Examiner*—L. T. Hix
*Assistant Examiner*—S. D. Schreyer
*Attorney, Agent, or Firm*—Steinberg & Blake

[57] ABSTRACT

A method and device according to which it becomes possible to operate a window shade automatically. Thus, by way of this method and device a window shade can be automatically closed during the night and automatically opened during the day. In this way it is possible to give to an unoccupied home an outside appearance tending to indicate that the occupants are at home.

1 Claim, 3 Drawing Figures

WINDOW SHADE CONTROLS AND METHOD ASSOCIATED THEREWITH

BACKGROUND OF THE INVENTION

The present invention relates to automatic control devices and to methods associated therewith.

The present invention deals particularly with the problem of giving to a home a condition according to which outsiders will tend to assume that the occupants of the home are in fact at home, even though the occupants may actually be away.

As is well known, burglars are prone to burglarize homes which are unoccupied. Thus, when the occupants of a given home go away on vacation, for example, it is customary to attempt to leave the unoccupied home in a condition according to which outsiders will tend to assume that the occupants of the home have not left. Thus, for this purpose it is known to connect timeclocks to lamps and radios for automatically turning them on during the evening and night hours while automatically turning them off at other times of day, so that in this way an attempt is made to give to an unoccupied home the appearance that it is in fact occupied. In this way attempts are made to deter burglarizing of an unoccupied home.

However, experience has shown that measures of this latter type are not always sufficient. Skilled and experienced burglars will normally keep a home, which may be an apartment or a private dwelling, under vigilance for a number of days in order to determine if the occupants of the home are in fact present. While the automatic turning on of lamps and radios during the evening and night hours will tend to indicate that in fact the occupants of a given home are present, there are other signs which will inform burglars that in fact the occupants of the home are not present.

One of the characteristics of a home which is watched by burglars is the condition of the window shades. Thus, even though a lamp may be turned on and off and even though sounds are heard from a radio, a skilled, experienced burglars will note that the window shades remain unchanged even though it is normal for the occupant of the home to close the shade at night and open it during the day. Thus, these conditions of the window shades of a home will accurately indicate to a burglar whether or not the occupants of the home are present or absent, even though lamps may go on and off and radios may be turned on and off.

Thus, at the present time the fact that the window shades of a home remain in an unchanged position over a long interval gives away the fact that the home very likely is unoccupied and thus is a good prospect for a burglary attempt.

SUMMARY OF THE INVENTION

It is accordingly a primary object of the present invention to provide a method and device which will solve the above problem.

In particular, it is an object of the present invention to provide a method and device according to which it becomes possible automatically to close and open a window shade at selected times so as to provide for a home an outside appearance which more closely approaches the appearance thereof when the occupants are present.

A particular object of the present invention is to provide a method and device of the above type which are particularly suited for use with Venetian blinds.

Also it is an object of the present invention to provide a method and device which enable the control for the window shade to be accompanied by controls for other components such as lamps and radios.

In addition, it is an object of the present invention to provide a method and device of the above type which are relatively inexpensive and simple.

According to the method of the invention a window shade is automatically closed and opened at predetermined times during each 24-hour interval, so as to attempt to provide in this way for a home an outside appearance closely approaching that which the home has when the occupants thereof are present.

With the device of the invention an operating means has a pair of positions and is operatively connected with a connecting means which serves to connect the operating means to a window shade in such a manner that the latter will be closed when the operating means assumes one of its positions and opened when the operating means assumes the other of its positions. A moving means, which preferably is electrical, is operatively connected with the operating means for moving the latter between the above positions thereof, and the times when the moving means moves the operating means between its positions can be preselected so that in this way it becomes possible automatically to close and open a window shade at given times during each 24-hour interval.

BACKGROUND OF THE INVENTION

The invention is illustrated by way of example in the accompanying drawings which form part of this application and in which.

DESCRIPTION OF PREFERRED EMBODIMENTS

Figure 1:
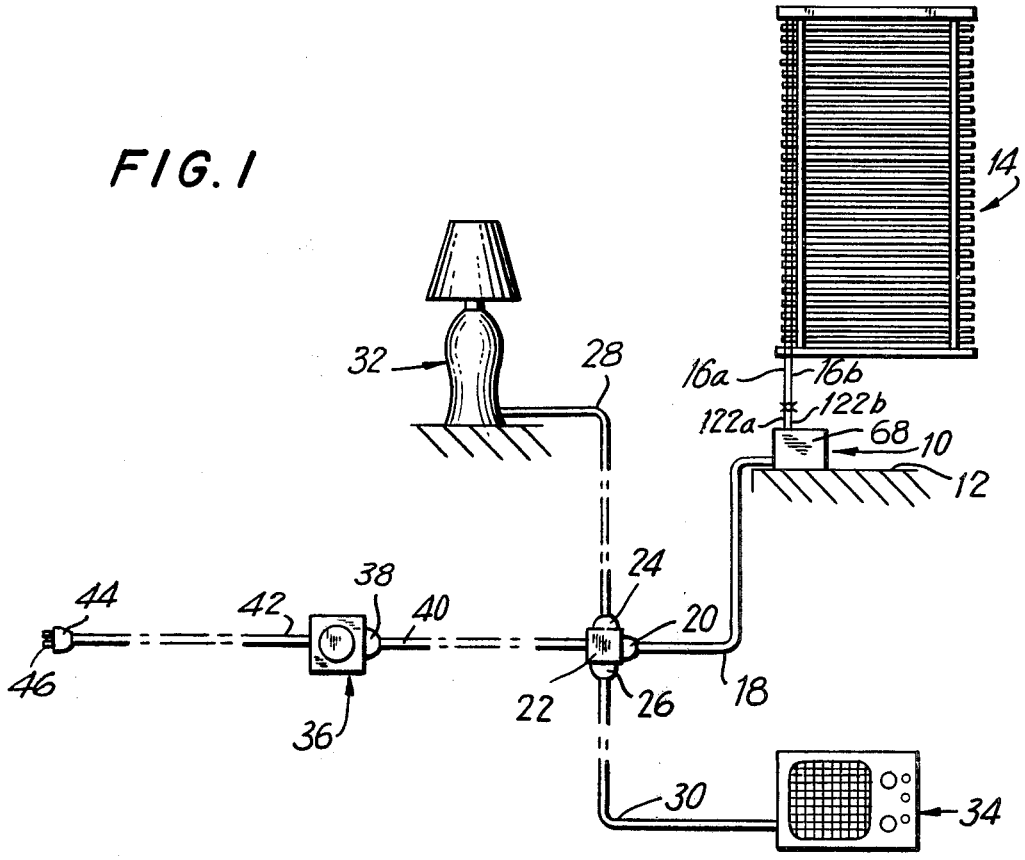
FIG. 1 is a schematic illustration of a device of the invention shown connected to a Venetian blind as well as connected with other appliances to a timeclock.

Referring now to FIG. 1, there is illustrated therein a device 10 of the present invention. This device 10 may, for example, be mounted on the schematically illustrated floor 12 beneath a window provided with the schematically illustrated shade in the form of a Venetian blind 14. This Venetian blind 14 includes a pair of strings **16*a*, 16*b* which, as is well known, can selectively be pulled downwardly for the purpose of opening or closing the shade 14. In a manner described in greater detail below, the device 10 of the present invention is connected to these shade-operating strings 16*a*, 16*b***.

The device 10 of the present invention is electrically operated in the illustrated example, and for this purpose it includes an electrical cord 18 terminating in a plug 20. The prongs of the plug 20 are received in a multiple electrical receptacle 22 which is illustrated as also receiving the plugs 24 and 26 which are connected through the electrical cables 28 and 30, respectively, to the illustrated lamp 32 and radio 34, respectively. Thus the device 10 of the present invention as well as the lamp 32 and radio 34 are capable of being turned on and off simultaneously, and for this purpose a conventional electrical timeclock 36 is utilized. The timeclock 36 has a receptacle receiving the prongs of a plug 38 which is connected through the electrical cord 40 with the multiple-receptacle 22. The timeclock 36 has its own cord 42 which terminates in the plug 44 having the prongs 46 which can be introduced into any wall outlet in a well known manner.

Figure 2:
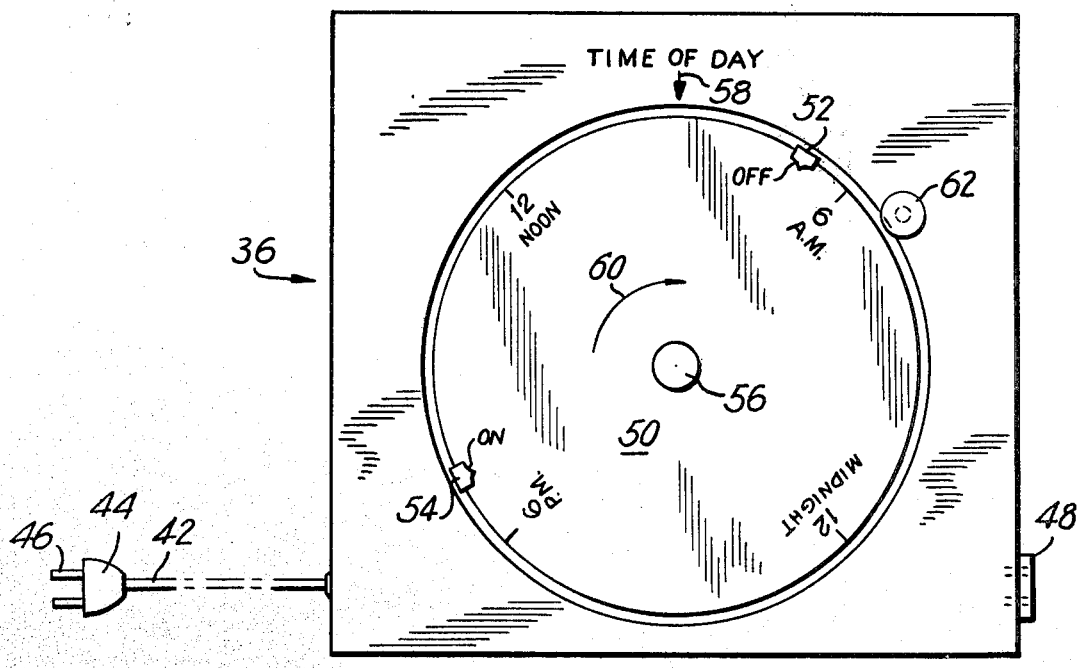
FIG. 2 shows in elevation a timeclock which may be used in the arrangement of FIG. 1.

One example of a timeclock 36 is illustrated in FIG. 2. Thus referring to FIG. 2 the illustrated timeclock 36 has the receptacle 48 which receives the prongs of the plug 38 which is shown in FIG. 1. This timeclock 36 through a suitable clock mechanism rotates a disc 50 so that the latter turns through one complete revolution during each 24-hour interval. The disc 50 carries a pair of switch-operating members 52 and 54 which can be turned along the periphery of the disc 50 as to be situated at a selected time therealong. Thus the switch operating member 52, which bears the designation OFF, is illustrated in FIG. 2 as being situated at 7 AM, while the switch-operating member 54, which bears the designation ON, is shown as situated along the periphery of the disc 50 at the time 5 PM.

As is well known, when the timeclock 36 is to be utilized, the plug 44 has its prongs 46 introduced into a suitable wall outlet, and by way of a knob 56, the disc 50 is turned so that the particular time of day is situated directly beneath the arrow 58. The disc 50 is then turned, in the direction of the arrow 60, in the same way as any electric clock is driven, with the transmission being such that the disc 50 completes one revolution every 24 hours. In the path of turning of the switch-operating members 52 and 54 is a switch element 62. When the switch-operating member 52 moves past the element 62, the latter is actuated so as to open a switch 64 (FIG. 3), whereas when the switch-operating member 54 moves past the element 62, the switch 64 will be closed. This timeclock structure is of course well known, and with the setting shown in FIG. 2, the switch 64 of FIG. 3 will be opened at 7 AM and will remain open until 5 PM, at which time the switch 62 will be closed by member 54 and will remain closed until 7 AM. Thus, in the position shown in FIG. 2 the switch 64 is closed and will be opened in approximately two hours at 7 AM.

Of course, when the switch 64 closes the radio 34 and the lamp 32 are energized so that these appliances are turned on, and at the same time the device 10 of the present invention is also energized, as is apparent from FIG. 1.

Figure 3:
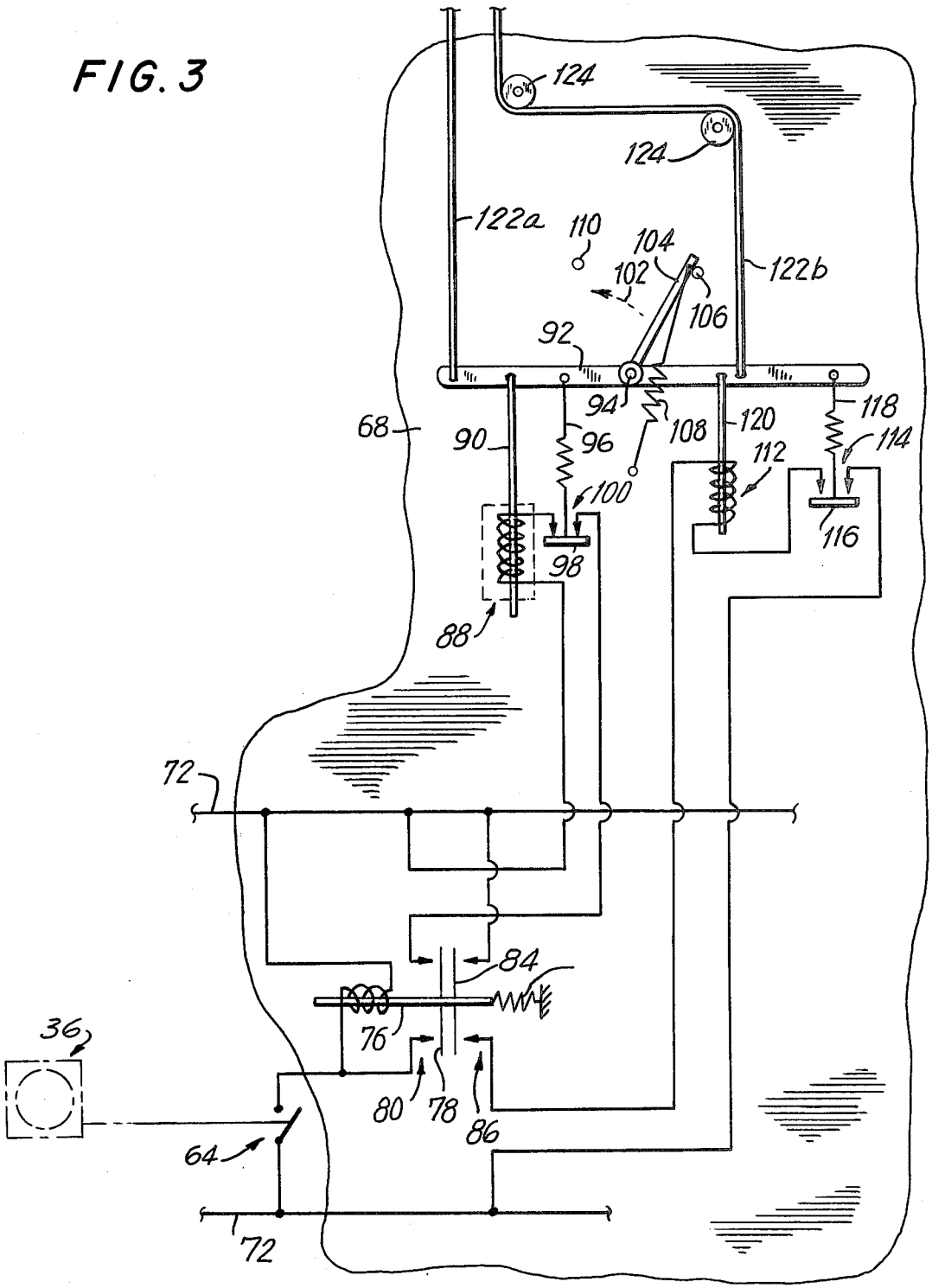
FIG. 3 schematically illustrates the details of one possible embodiment of a device according to the invention.

As is schematically shown in FIG. 3, the device 10 includes a housing 68, part of which is indicated schematically in FIG. 3, and within this housing is a solenoid 70 which is connected between the lines 72 in series with the timeclock switch 64. Thus when the switch 64 is closed the solenoid 70 is energized. The armature 74 of the solenoid will displace, when the solenoid is energized, the switch element 78 to a position closing the switch 80. When the solenoid 70 is unenergized, a spring 82 acts to displace a switch element 84 to its closed position closing the switch 86. Thus, when the switch 64 is open the switch 86 is closed while when the switch 64 is closed the switch 80 is closed and the switch 86 is opened.

Connected in series with the switch 80 between the lines 72 is a further solenoid 88 the armature 90 of which is connected to a lever arm 92 supported for pivotal movement by a pivot pin 94 carried by a wall of the housing 68. The lever 92 is connected with an elongated springy member 96 which operates a switch element 98, forming part of the switch 100 which is in series with the solenoid 88. Thus, in the position of the parts shown in FIG. 3, the switch 100 is closed, and upon closing of the switch 80 the solenoid 88 will be energized to pull on the armature 90 and turn the lever 92 in a counterclockwise direction, as indicated by the arrow 102.

A rod 104 is fixed to the lever 92 for turning movement therewith and in the position shown in FIG. 3 engages a stop member 106 which is carried by the wall of the housing 68. An over-center spring 108 is connected with the rod 104 so as to maintain the parts in the position illustrated in FIG. 3. Upon energizing of the solenoid 88, the pulling of the armature 90 will cause the lever 92 to turn in the direction of the arrow 102 so as to displace the rod 104 beyond its vertical position, in the direction of the arrow 102, and the over-center spring 108 will then bring the rod 104 into engagement with the stop member 110.

A further solenoid 112 is connected in series with the switch 86 between the lines 72, and a further switch 114 is connected in series with the solenoid 112. This switch 114 has a switch member 116 which through the springy element 118 is connected to the lever 92. This lever 92 also is connected to the armature 120 of the solenoid 112.

The lever 92 is connected on opposite sides of its pivot 94 with a pair of elongated flexible members 122*a* and 122*b*, the latter being guided by suitable rollers 124 carried by the housing 68 as illustrated. The flexible members 122*a* and 122*b* pass through a suitable opening in a top wall of the housing 68 and are connected to the strings 16*a* and 16*b* in the manner shown schematically in FIG. 1 in any suitable way as by being knotted thereto. Thus, the string 16*a* will move together with the string 122*a* and the string 16*b* will move together with the string 122*b*.

The operator will simply place the device 10 on the floor 12 and connect the flexible members 122*a* and 122*b* to the strings of the Venetian blind in a manner shown in FIG. 1.

When the above structure of the invention is connected as shown in FIG. 1, the member 54 of the clock 36 will when engaging element 62 close the switch 64, with the result that the switch 80 will close, thus energizing the solenoid 88 to pull the left arm of the lever 92 downwardly, thus pulling down on the member 122*a* as well as the string 16*a*, and this downward movement of the string 16*a* will serve to turn the slats of the Venetian blind 14 so as to close the latter. At the same time, the downward movement of the left arm of the lever 92, as viewed in FIG. 3, will displace element 98 downwardly in order to open the switch 100, but the over-center spring 108 will maintain the rod 104 in engagement with the stop 110 so that the shade 14 will remain closed even though the solenoid 88 is no longer energized. However, the solenoid 70 remains energized and the switch 80 remains closed. Thus, it is seen that spring 108 functions as a toggle means for maintaining lever arm 92 in one of the two positions after deactivation of the respective solenoids 88,112.

This turning of the lever 92 in the direction of the arrow 102 causes the switch element 116 to be displaced upwardly through the springy connector 118 so that the switch 114 becomes closed, but the solenoid 112 is not energized because the switch 86 remains open, and of course at this time the spring 82 is under tension.

Thus, with the clock 36 set in the manner illustrated in FIG. 2, the shade 14 will be maintained closed from approximately 5 PM until 7 AM. At 7 AM the element 52 will actuate the switch-operating element 62 so as to open the switch 64, and now the solenoid 70 will become unenergized while the spring 82 will contract in order to close the switch 86. Thus at this time the solenoid 112 will become energized and the lever 92 will be pulled in a clockwise direction about the pivot 94, as viewed in FIG. 3, until the rod 104 engages the stop member 106 as illustrated. The result is that the string **122*b* will be pulled and will act on the string 16*b* in order to open the shade 14, and at the same time the switch element 116 will be free to move downwardly to the position shown in FIG. 3, thus opening the switch 114 so that the solenoid 112 becomes energized, but of course the spring 108 will maintain the parts in the position shown in FIG. 3. It will be noted, however, that this turning of the lever 92 in a clockwise direction, as viewed in FIG. 3, has displaced switch element 98 upwardly so as to close the switch 100, and thus the solenoid 88 is in a condition to be energized as soon as the switch 80 is again closed. Of course this switch 80 will become closed upon closing of the switch 64 when the element 54 of the clock 36 again operates the element 62 of the switch 64**.

Thus, through the structure described above it is possible automatically to open and close the shade 14 at selected times during each 24-hour interval.

It is thus apparent that the lever 92 together with the rod 104, the spring 108, and the stops 106 and 110 form an operating means which is movable between the positions where the rod 104 engages the stops 106 and 110. The flexible members **122*a* and 122*b*, which can themselves be in the form of suitable strings or cords, serve as a connecting means for connecting the operating means to the strings 16*a* and 16*b*** of the Venetian blind for operating the latter in the manner described above, so that the shade is closed in one position of the operating means and opened in the other position of the operating means.

The electrical structure of FIG. 3, including the solenoids thereof and the switches forms an electrical moving means operatively connected with the operating means for displacing the latter between its positions opening and closing the shade at selected times during each 24-hour interval, as described above.

Thus, by way of the method and apparatus of the present invention it is possible automatically to operate a window shade 14 in such a way that a home will appear from the exterior as if the occupants thereof are present, and of course this effect is enhanced by the illumination of the lamp 32 and/or the turning on of the radio 34 simultaneously with the closing of the shade 14. Of course the lamp 32 is turned off, and the radio 34 is also turned off, simultaneously with the opening of the shade 14.

What is claimed is:

1. A device for automatically controlling a window shade comprising:

a lever arm pivotally mounted for movement between a first and second position;

first solenoid means coupled to said lever arm for pivotting said lever arm to said first position in response to electrical activation by electrical timing means;

second solenoid means coupled to said lever arm for pivotting said lever arm to said second position in response to electrical activation by electrical timing means;

first switch means for deactivating said first solenoid means upon said lever arm pivotting to said first position;

second switch means for deactivating said second solenoid means upon said lever arm pivotting to said second position;

spring toggle means coupled to said lever arm for maintaining said lever arm in either of said first and second positions after deactivation of said first or second solenoid means respectively by said first or second switch means respectively;

electrical timing means electrically coupled to said first and second solenoid means to sequentially activate and deactivate the latter according to a predetermined timing sequence; and a pair of elongated flexible members, each having one end connected to a respective end portion of said lever arm and another end adapted to be connected to one of a pair of strings of a Venetian blind, so that when said lever arm assumes said first position, one of the Venetian blind strings is pulled by one of the elongated flexible members and when said lever arm assumes the second position, the other of said Venetian blind strings are pulled by the other of the elongated flexible members.

* * * * *